United States Patent [19]

Kim et al.

[11] 4,134,191

[45] Jan. 16, 1979

[54] METHOD AND APPARATUS TO BLOW YARN AND PLUG FROM HIGH TEMPERATURE YARN TEXTURING JET DEVICE WHEN YARN FLOW STOPS

[75] Inventors: Dong W. Kim; Leonard J. Aberle, both of Chester, Va.

[73] Assignee: Allied Chemical Corporation, Morris Township, Morris County, N.J.

[21] Appl. No.: 770,123

[22] Filed: Feb. 18, 1977

Related U.S. Application Data

[63] Continuation-in-part of Ser. No. 720,174, Sep. 3, 1976, abandoned.

[51] Int. Cl.[2] ..... D02G 1/16; D02H 7/00

[52] U.S. Cl. ..... 28/248; 28/255; 28/271

[58] Field of Search ..... 720/174; 28/248, 255, 28/271; 57/81

[56] References Cited

U.S. PATENT DOCUMENTS

| | | | |
|---|---|---|---|
| 3,409,956 | 11/1968 | Longbottom et al. | 28/255 |
| 3,438,188 | 4/1969 | Boggs | 57/81 |
| 3,842,468 | 10/1974 | Harrison | 28/248 |

*Primary Examiner*—Louis K. Rimrodt
*Attorney, Agent, or Firm*—Richard A. Anderson

[57] ABSTRACT

Apparatus and method are disclosed to prevent melted yarn when stopped in a high temperature texturing jet device utilizing high temperature fluid such as steam. The device of this invention is attached to the prior art texturing jet device. The attachment comprises a sleeve around the yarn ejector. The sleeve has at least two orifices communicating with a conduit for high pressure fluid having a valve actuated by a sensor to detect yarn stoppage. The high pressure fluid, such as air, blows the yarn plug and yarn from the texturing jet device. The method comprises sensing yarn stoppage with a sensor and actuating the valve in the high pressure fluid conduit communicating with at least two orifices in the sleeve surrounding at least the down stream portion of the injector and blowing any yarn in the texturing chamber out of the chamber with high pressure fluid.

6 Claims, 3 Drawing Figures

METHOD AND APPARATUS TO BLOW YARN AND PLUG FROM HIGH TEMPERATURE YARN TEXTURING JET DEVICE WHEN YARN FLOW STOPS

RELATED APPLICATIONS

This application is a continuation-in-part of U.S. Ser. No. 720,174 filed Sept. 3, 1976 now abandoned.

BACKGROUND OF THE INVENTION

This invention relates to apparatus and method to prevent melted yarn when stopped in a high temperature yarn texturing jet such as the one shown in U.S. Pat. No. 3,409,956 to Longbottom et al., hereby incorporated by reference.

The prior art high temperature fluid (such as steam) texturing jets, such as the above-mentioned Longbottom jet, are presently used to texture a continuous running length of nylon or other synthetic yarn to bulk it so that it can be tufted or woven into carpets. These prior art jets used superheated steam at a temperature greater than the yarn melting point. When the yarn is in motion, heat transfer to the yarn is insufficient to melt it. However, process interruptions due to many different causes can occur. Any process interruption which causes the yarn to stop in the jet may cause the yarn to melt in the jet. The jet must then be removed and cleaned to remove the melted polymer by solvent or other means. The melted yarn causes prolonged down time of a portion of the continuous yarn texturing process in addition to the expense of cleaning the jet.

The prior art device described in U.S. Pat. No. 3,842,468 to Harrison, hereby incorporated by reference, has been successfully used for processing most ordinary yarn. However, for the new lower denier higher crimp yarn, prior art devices have not successfully prevented melted yarn when stopped in the high temperature jet.

SUMMARY OF THE INVENTION

This invention consists of a device attached to a high temperature yarn texturing jet such as the one disclosed in the above-mentioned Longbottom et al. patent.

The device provides a method to prevent melted yarn when stopped in a high temperature texturing jet device. The prior art texturing device comprises an injector having an internally disposed passage for yarn, fluid inlet means for supplying a heated fluid under pressure through the injector passage, a texturing chamber concentrically disposed at one end of the injector passage and being adapted to contain a compacted yarn mass, the texturizing chamber having a larger cross sectional area than the cross sectional area of the injector such as to form an annulus between the outer periphery of said injector and the inner periphery of the texturizing chamber and fluid exit means positioned at the annulus adapted to discharge fluid from the texturizing zone in a direction substantially opposite to yarn path travel. The method of this invention comprises sensing yarn stoppage with a sensor and actuating a valve in a high pressure fluid conduit communicating with at least two orifices in a sleeve surrounding at least the down stream portion of the injector, and blowing any yarn in the texturizing chamber out of the chamber with high pressure fluid and thereby pulling any yarn in the injector out with the yarn in the chamber. The high pressure fluid, such as air, flows from the conduit through the orifices and sleeve into the chamber through the annulus so that when yarn stops, the yarn will be removed rather than melted in the chamber and in the injector by the heated fluid, such as steam, and/or the heat latent in the chamber and the injector. Also, the chamber and the injector are cooled by the high pressure fluid, such as air. The preferred high pressure fluid is air and the preferred high temperature fluid is steam. Also, preferably, the valve remains actuated in the open position for 3 to 10 seconds and the air is under pressure from about 50 to about 100 psig.

The prior art apparatus for texturing yarn is described above. The improvement device of this invention comprises a sleeve surrounding at least the down stream portion of the injector. The sleeve has at least two orifices communicating with a conduit for high pressure fluid having a valve actuated by a sensor to detect yarn stoppage.

This improved apparatus achieves the same result regarding yarn stopped in the hot chamber and injector as described in conjunction with the method above. The preferred sensor is a feeler arm or roller situated to contact the continuous running length of yarn as set forth in U.S. Pat. No. 3,438,188 to Boggs, hereby incorporated by reference, or a device sensing roll stoppage, i.e., on the feeder or other takeup type rolls, such as Godet rolls. The sensor may be coupled electrically or by other means to a solenoid valve or similar means for controlling the flow of high pressure fluid to the orifice in the sleeve of the invention of this device. Other means of sensing yarn stoppage are optical or electrical capacitance sensors well known in the art. By orifice is meant the opening in the sleeve to permit entry of the high pressure fluid. Preferably, the sleeve surrounds the entire injector. This sleeve can be closed, that is, tight fitting or it can preferably be open at either or both ends, that is, the sleeve would have a gap between it and the body of the texturing jet.

DESCRIPTION OF A PREFERRED EMBODIMENT

Figure 1:
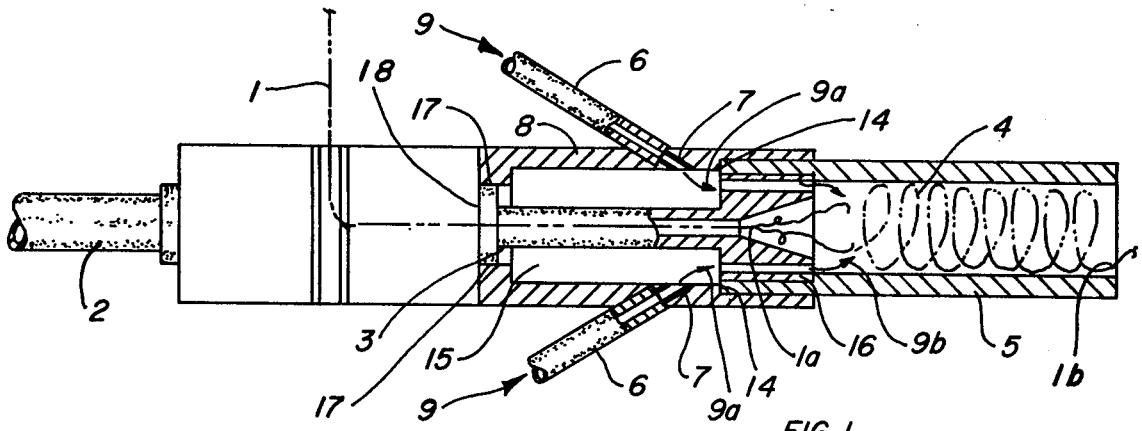
FIG. 1 is a right hand partial cross-section view of the device of this invention attached in position on the yarn texturing jet device.

Referring now to FIG. 1, the right-hand partial cross-section view of the device of the invention attached in position on the yarn texturing device, yarn 1 is propelled by steam from steam conduit 2 into injector 3, and yarn shown at 1A exits to impact against yarn plug 4 in texturing chamber or stuffer tube 5, the textured yarn then exits as shown at 1B. When a yarn stoppage occurs, high pressure air enters through air conduit 6 and orifice 7 in sleeve 8. Movement of air is shown by arrows 9, 9A, and 9B. Air enters through conduit 6 as shown by arrow 9, proceeds through the annulus 15 as shown by arrow 9A, and then proceeds through vent hole 16 in annulus 15 as shown by arrows 9B. This high pressure air as shown by the arrows 9 forces yarn plug 4 from the exit of stuffer tube 5. Also shown in FIG. 1 are shoulder 14 on sleeve 8 meeting stuffer tube 5, and reduced diameter section 17 on sleeve 8 which meets with injector tube fittting 18 to close sleeve 8. Thus, sleeve 8 is closed at both ends.

Figure 2:
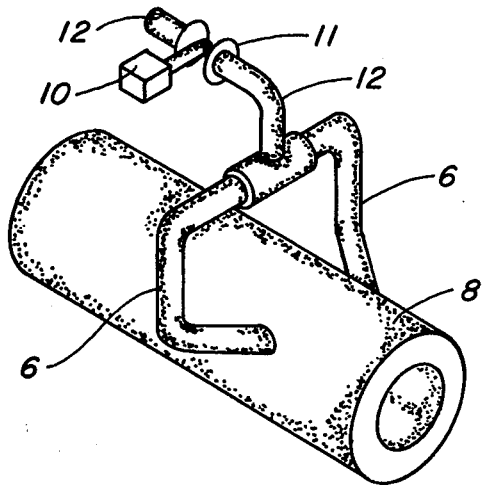
FIG. 2 is an isometric schematic view of the device of this invention.

In FIG. 2 the isometric schematic view of the device of this invention shows sensor 10 connected to valve 11 in feeder line 12. Feeder line 12 feeds high pressure fluid to conduit 6 which connects to sleeve 8.

Figure 3:
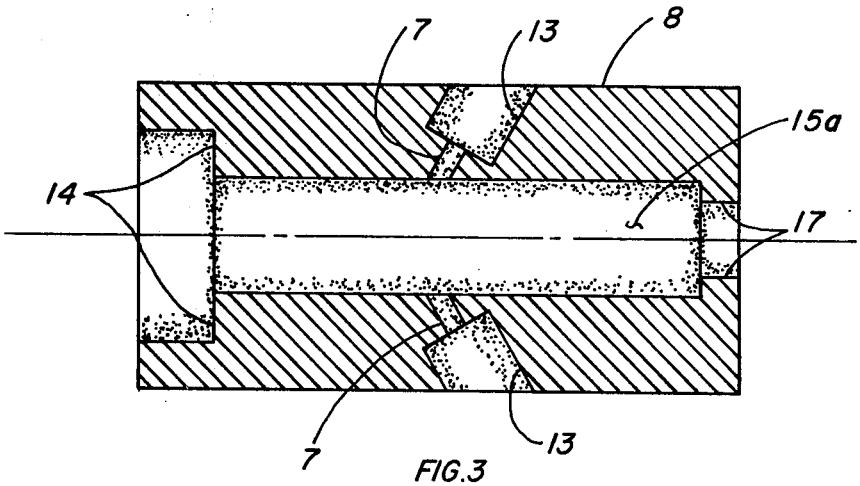
FIG. 3 is a left hand cross-section view of the sleeve portion of this invention.

FIG. 3 shows in detail the connection for sleeve 8 to conduit 6. Conduit 6 fits into socket 13 to communicate with orifices 7. Also shown is shouler 14 which meets with stuffer tube 5 and reduced diameter 17 which fits to injector tube fitting 18 in order to seal sleeve 8 at both ends thereby making sleeve 8 a closed sleeve. Cavity 15*a* becomes the annulus 15 shown in FIG. 1.

In operation, yarn sensor 10 would sense the stoppage of the yarn flow into the jet texturing device and activate valve 11 which would open to permit high pressure air to flow through feeder line 12 into conduit 6 and thereby into orifices 7 through annulus 15 and vent hole 16 to push the yarn plug 4 from the hot steam jet texturing device. Yarn plug 4 would pull out any yarn remaining in injector 3.

EXAMPLE

The device of this invention utilizes high pressure air flow through the energy tube or injector vent holes at the upsteam end of the stuffer tube as shown in the drawings above, thus blowing out the plug instantaneously in case of possible jet burn out. Preferably, the device supplys 80 psig. air pressure for a 5-second burst to clear the plug out of the stuffer tube eliminating cleaning by the operator and possible melting of the yarn by the latent heat or the steam heat.

During a two-week trial, the attachment of the antiburn out device of this invention to the texturing jet of U.S. Pat. No. 3,409,956, incorporated by reference above, reduced steam jet burnouts from 6 to 1.7 jet burnouts per panel per day when processing 1,225 denier yarn having about 10 denier per filament.

The advantages over the prior art are as follows:

(1) Reduction in jet burnout rate.
(2) Increase of production by lowering jet replacement downtime.
(3) Reduction in jet inventory.
(4) Self-cleaning jet by blowing plug out.
(5) Easy to install.
(6) Easy to fabricate.
(7) Rugged construction requiring little maintenance.
(8) Safe to operate.

We claim:

1. A method to prevent melted yarn when stopped in a high temperature texturing jet device, said texturing device comprising an injector having an internally disposed passage for yarn, fluid inlet means for supplying a heated fluid under pressure through said injector passage, a texturizing chamber concentrically disposed at one end of said injector passage and being adapted to contain a compacted yarn mass, said texturizing chamber having a larger cross-sectional area than the cross-sectional area of said injector such as to form an annulus between the outer periphery of said injector and the inner periphery of said texturizing chamber and fluid exit means positioned at said annulus adapted to discharge fluid from said texturizing zone in a direction substantially opposite to yarn path travel, said method comprising sensing yarn stoppage with a sensor, and actuating a valve in a high pressure fluid conduit communicating with at least two orifices in a sleeve surrounding at least the downstream portion of said injector, and blowing any yarn in said texturing chamber out of said chamber with high pressure fluid and thereby pulling out any yarn in said injector with said yarn in said chamber, said high pressure fluid flowing from said conduit through said orifices and sleeve and into said chamber through said annulus so that when said yarn stops, said yarn will be removed rather than melted in said chamber and in said injector by said heated fluid and/or the heat latent in said chamber and injector, and so that said chamber and said injector are cooled by said high pressure fluid.

2. The method of claim 1 wherein said high pressure fluid is air and said heated fluid is steam.

3. The method of claim 2 wherein said valve remains actuated in the open position for 3 to 10 seconds and said air is under pressure of from about 50 to 100 psig.

4. In an apparatus for texturizing yarn which comprises an injector having an internally disposed passage for yarn, fluid inlet means for supplying a heated fluid under pressure through said injector passage, a texturizing chamber concentrically disposed at one end of said injector passage and being adapted to contain a compacted yarn mass, said texturizing chamber having a larger cross-sectional area than the cross-sectional area of said injector such as to form an annulus between the outer periphery of said injector and the inner periphery of said texturizing chamber and fluid exit means positioned at said annulus adapted to discharge fluid from said texturizing zone in a direction substantially opposite to yarn path travel, the improvement comprising a sleeve surrounding at least the downstream portion of said injector, said sleeve having at least two orifices communicating with a conduit for high pressure fluid having a valve actuated by a sensor to detect yarn stoppage, said high pressure fluid flowing from said conduit through said orifices and sleeve and into said chamber through said annulus so that when said yarn stops, said yarn will be removed rather than melted in said chamber and in said injector by said heated fluid and/or the heat latent in said chamber and injector, and so that said chamber and said injector are cooled by said high pressure fluid.

5. The apparatus of claim 4 wherein said sensor is a feeder arm situated to contact said yarn.

6. The apparatus of claim 4 wherein said sleeve surrounds the entire said injector.

* * * * *